United States Patent [19]

Sigman

[11] 4,291,746

[45] Sep. 29, 1981

[54] APPARATUS FOR STRIPPING INGOTS FROM MOLDS

[75] Inventor: Earl H. Sigman, Alliance, Ohio

[73] Assignee: AMCA International Corporation, Alliance, Ohio

[21] Appl. No.: 3,307

[22] Filed: Jan. 15, 1979

[51] Int. Cl.[3] ..... B22D 29/08

[52] U.S. Cl. ..... 164/407; 164/405

[58] Field of Search ..... 164/405, 407, 408, 404, 164/401

[56] References Cited

U.S. PATENT DOCUMENTS

| | | | |
|---|---|---|---|
| 2,007,275 | 7/1935 | Kendall | 164/405 |
| 3,064,324 | 11/1962 | Schafer | 164/405 |
| 3,460,610 | 8/1969 | Baker | 164/405 |
| 3,469,722 | 9/1969 | Burrows | 164/405 X |

FOREIGN PATENT DOCUMENTS

| | | | |
|---|---|---|---|
| 1010242 | 6/1957 | Fed. Rep. of Germany | 164/407 |
| 1031938 | 6/1958 | Fed. Rep. of Germany | 164/405 |
| 1046270 | 12/1958 | Fed. Rep. of Germany | 164/407 |
| 1458159 | 12/1968 | Fed. Rep. of Germany | 164/405 |
| 33888 | 1/1964 | Finland | 164/405 |
| 419121 | 3/1947 | Italy | 164/405 |

*Primary Examiner*—Robert L. Spruill
*Assistant Examiner*—Gus T. Hampilos
*Attorney, Agent, or Firm*—Frederic M. Bosworth; Neil A. DuChez

[57] ABSTRACT

An improvement in and pertaining to cranes for stripping and/or handling cast metal ingots. The improvement is disclosed in the illustrative environment of a crane capable of performing both functions and operations with big-end-down ingots and molds. The improvement is embodied in a horizontally disposed component of a vertical, crane-suspended, ingot working mechanism. Said component serves as a shock absorber and dampener during a stripping operation, and serves as a resilient energy reservoir in aid of an ingot handling operation. Said component takes a horizontal drum-shaped form with centrally apertured, resilient, spring tempered steel discs disposed like the heads of a drum normal to said mechanism wherein, however, the inner peripheries of said apertures engage parts of the mechanism between which there is relative vertical motion in one direction incident to stripping the ingot from the mold, and in the opposite direction when gripping the ingot to handle it. The inner peripheries of the apertures in each disc always engage externally and separately, with freedom for the discs to flex, relatively movable coaxial vertical tubular elements of the mechanism which sustain and/or transmit the essential forces and motions to effect the respective ingot stripping and handling operations.

5 Claims, 8 Drawing Figures

FIG. 3
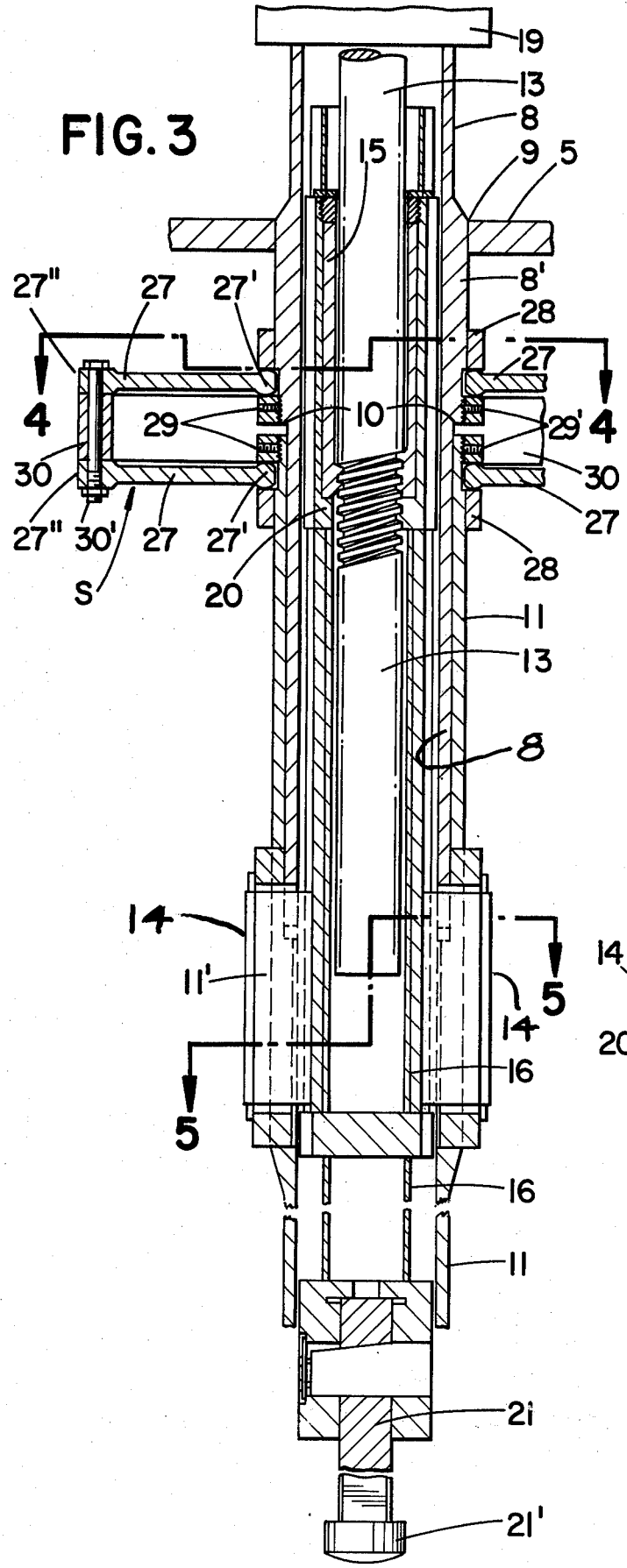
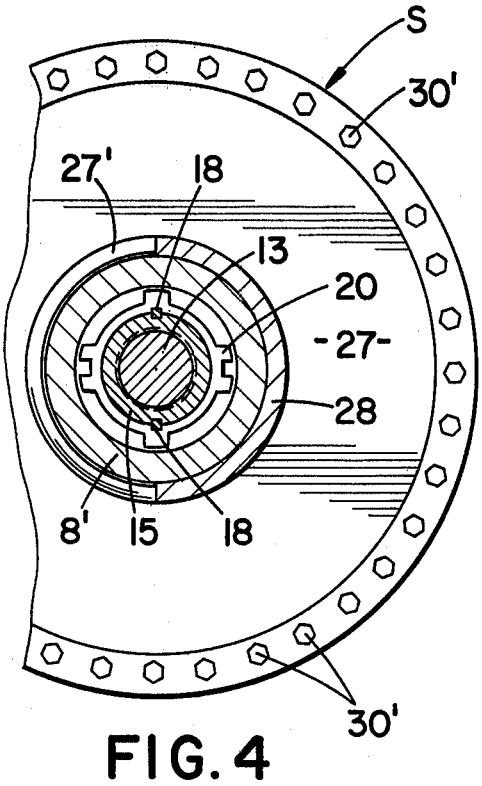
FIG. 4
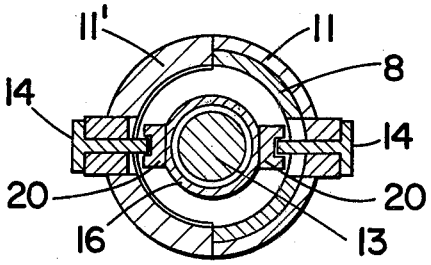
FIG. 5

APPARATUS FOR STRIPPING INGOTS FROM MOLDS

BRIEF SUMMARY OF THE INVENTION

In the prior art pertaining to ingot stripping and handling cranes, complex, incomplete disclosures and passing mention has been made of shock absorbers as in the Kendall U.S. Pat. No. 2,007,275 and in my assignee's Baker U.S. Pat. No. 3,460,610. Prior art, so called shock absorbers, appear to have been patched up and added on to orthodox, unprotected and shock-belabored cranes and their ingot stripping and/or handling mechanisms, without teaching the advantage of integrating the shock absorber into the design and function of the whole mechanism in the first instance. Nor has the prior art attempted to provide a simple, economical, compact and durable shock absorbing device having a central major role around which the bearings and other shock-inflicted parts of the crane and ingot working mechanism could be lightened and preserved for longer life and more effective service.

The shock absorber embodying my invention is integrated into the heart and center of the ingot stripping and handling mechanism. More particularly the ingot working portion of the crane-suspended mechanism comprises two relatively slideable, vertically and coaxially telescoped tubular sleeves through and between which the shocks, reactions, forces and motions of stripping and handling the ingot are transmitted or reflected. My shock absorber comprises a drum-like, or barrel-like, device having a pair of centrally apertured flat, circular, spring-tempered horizontally disposed discs spaced apart and connected by an external ring at their outer peripheries, and are connected with both said sleeves at their inner apertured peripheries to dampen the shock of stripping and aid in preserving a resilient grip of the tongs on the ingot for and while handling it.

The rounded periphery of the central aperture of the upper horizontal disc of my shock absorber is held, not too tightly but securely, in an external annular groove formed around the exterior of the lower end of the large diameter part of the midportion of the first and higher of said vertical sleeves where the said midportion is sharply reduced in diameter enough to enter and have a sliding telescopic fit with the lower and second of said sleeves. The upper end of the second sleeve has the same external diameter and groove as the said large part of said midportion and terminates near the place where the said midportion of the first sleeve is reduced in diameter. The internal rounded annular periphery of the aperture of the lower horizontal disc is held, not too tightly, but securely, in the said external groove in the upper end of said second sleeve.

The two sleeves are spaced apart vertically between said external grooves enough to permit said discs to flex freely under loads which tend to test the limit of motion between the sleeves.

The first and second sleeves are splined together to prevent relative rotary motion while permitting relative axial motion therebetween. The first sleeve is secured fixedly in the upper part of the mechanism which, with the driving motor, driven screw, push rod and tongs, is all rotatably supported in relation to the frame that is directly suspended from the overhead, traveling crane. The second sleeve extends downwardly outside the first sleeve to and engaging the head in which are suspended the tongs that engage the ingot and mold selectively.

Both sleeves enclose the ingot engaging push rod or ram, the enlarged lower end of which also serves to engage and actuate the tongs and cause them to grip the mold or the ingot selectively.

My invention is more succinctly concerned with the structure, function, mode of operation and results of my shock absorber and the way it is connected to and coacts with the ingot working mechanism through said sleeves under the stresses and strains incident to separating ingots from molds and handling the separated ingots.

BRIEF DESCRIPTION OF THE SEVERAL VIEWS OF THE DRAWINGS

FIG. 3 is an enlarged longitudinal sectional view in the plane of FIG. 2 of the upper part of the ingot stripping and handling mechanism;

FIG. 4 is a broken horizontal cross sectional view taken in the planes of the line 4—4 of FIG. 3, showing also a fragmentary top plan view of my shock absorber;

FIG. 5 is another broken horizontal sectional view taken at a lower level in FIG. 3 in the planes of the line 5—5;

DETAILED DESCRIPTION OF A PREFERRED FORM OF THE INVENTION

Figure 1:
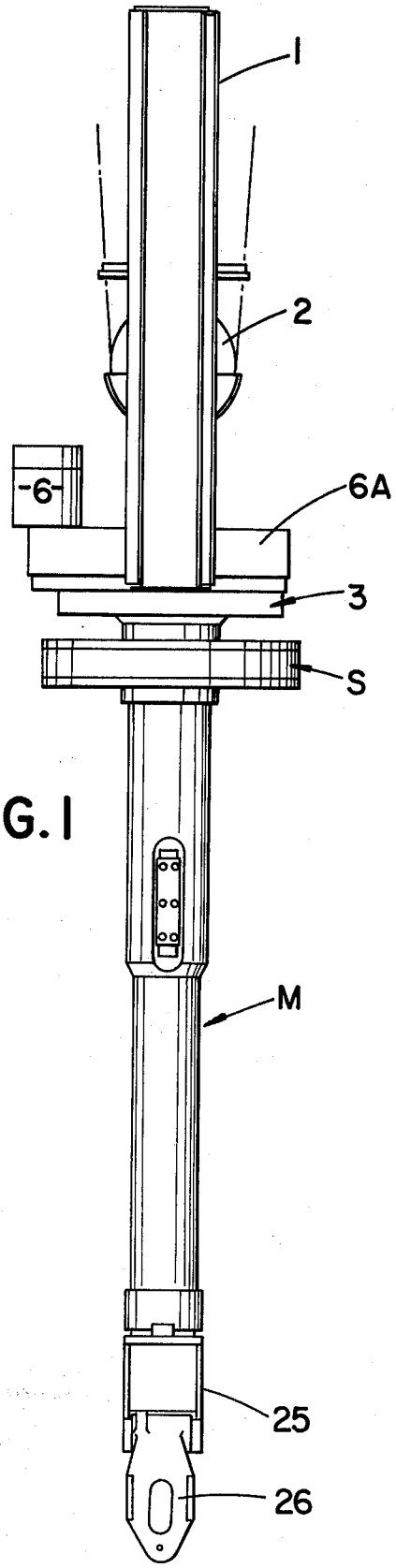
FIG. 1 is a vertical side elevation of the ingot stripping and handling mechanism having my improved shock absorber, all as suspended and controlled from a traveling overhead crane.
Figure 2:
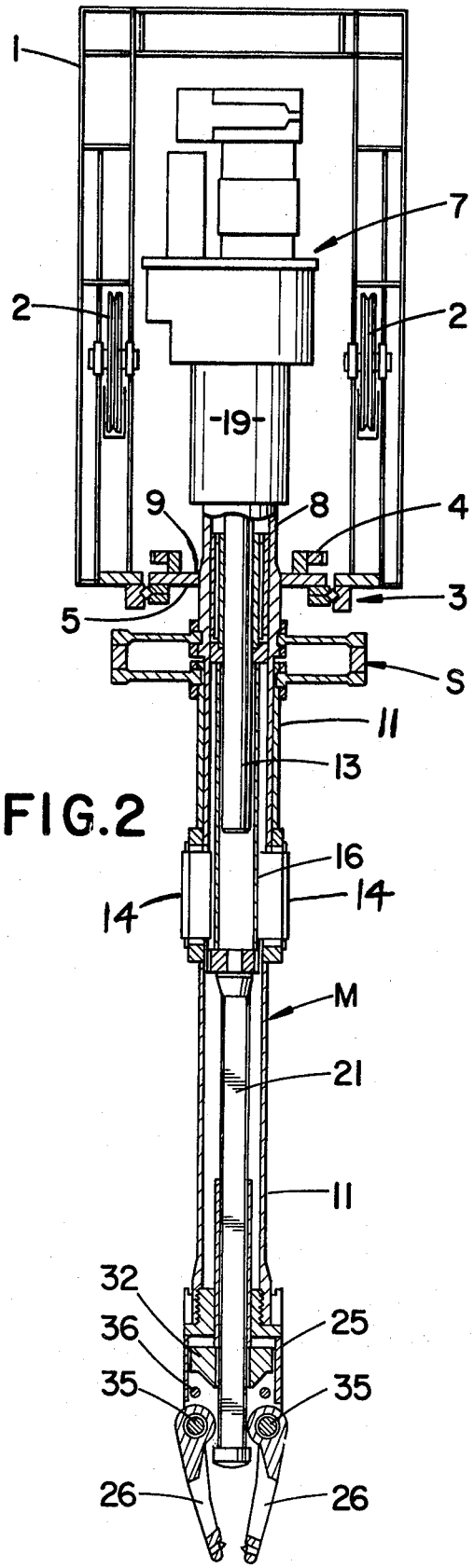
FIG. 2 is a vertical, front elevation of the mechanism of FIG. 1, partly in longitudinal section and partly diagrammatic.

Referring to FIGS. 1 and 2 of the drawings, the uppermost part of the preferred form of my crane-suspended, ingot stripping and handling mechanism embodying my invention and improvements (hereinafter ingot working mechanism M) comprises a strong, structural, open, rectangular frame 1 of greater width, FIG. 2, than thickness, FIG. 1, within the vertical sides of which are mounted sheaves 2 under and around which are passed conventional wire ropes that extend upwardly to appropriate anchors and hoists carried by a conventional overhead traveling crane and trolley, not shown. With such facilities the crane operator may raise and lower the frame and all the ingot working mechanism, ingots and molds carried thereby, as well as move them fore and aft, and right and left.

At the bottom of frame 1 there is carried and secured the outer race, FIG. 2, of a great annular anti-friction bearing 3, the inner race of which supports a stout circular load-bearing plate 5 upon which is carried an annular gear 4 through which everything carried by bearing 3 is rotatable relative to frame 1. As suggested in FIG. 1, a vertical motor 6 is mounted on a horizontal supporting structure 6A outside frame 2, and carries a pinion gear, not shown, which engages gear 4 to rotate it. Motor 6 has appropriate leads and controls to permit the crane operator to rotate plate 5, and everything carried by it, in either direction at appropriate speeds.

Carried by and above plate 5 is the assembly 7, comprising, the main driving motor with its brake, controls and collector rings, along with reduction gearing and the thrust bearing for the screw 13, all below the motor, for driving screw 13, see also FIG. 3, rotatably in either direction to effect downward axial motion of the push-rod or ram 21 and also to open and close tongs 26 at the lower end of the ingot working mechanism. The thrust bearing in assembly 7 is preferably similar in function and operation to the thrust bearing disclosed and claimed in said Baker U.S. Pat. No. 3,460,610 in that it secures screw 13 against axial motion relative thereto, and to assembly 7, and ingot working mechanism M, while providing free rotation of the screw in the bearing. Housing 19 of the thrust bearing of assembly 7, supports all of the assembly 7 which stands above it and is in turn joined to and supported by the uppermost end of the upper tubular sleeve 8, FIGS. 2 and 3.

The thickened midportion 8′ of sleeve 8 passes through the center of plate 5 and is firmly secured thereto and integrated therewith as at 9, FIGS. 2 and 3, wherewith the burden of the assembly 7 above, and ingot working mechanism M below, is transferred to frame 1 through bearing 3. The thicker portion 8′ is reduced in external diameter abruptly at 10, FIG. 3, down to a free sliding lubricated fit within lower tubular sleeve 11. The external diameter of sleeve 11 is the same as that of the adjacent part of portion 8′ of sleeve 8 wherewith to engage and support the equal inner peripheries 27′ of the central apertures in discs 27, FIGS. 3 and 4, comprising shock absorber S embodying my invention.

As shown in FIGS. 3 and 4, it will appear that shock absorber S suspends sleeve 11 resiliently, as well as all the mechanism carried by sleeve 11, from the thick part of sleeve 8. Welded to the exterior cylindrical surface of thick portion 8′ of sleeve 8 is a upper ring 28 which restrains the inner periphery 27′ of the central aperture in upper disc 27 from upward motion relative to sleeve 8. In the same way lower ring 28 is welded to the exterior of sleeve 11 to restrain the inner periphery 27′ of the central hole in lower disc 27 from downward motion relative to sleeve 11. Similarly but with opposite effect, internally threaded lock rings 29 are threaded onto externally threaded parts of the lower end of portion 8′ and the upper end of sleeve 11 wherewith to restrain the rounded and thickened inner peripheries 27′ of upper disc 27 from downward motion relative to portion 8′ and to restrain the similar inner periphery 27′ of lower disc 27 from upward movement relative to sleeve 11. Lock rings 29 are tightened only enough to make metal-to-metal contact between rings 28 and 29 with rounded peripheries 27′ without impairing the flexing of discs 27 by binding the peripheries 27′ between the rings. Lock rings 29 are secured in their desired locations by set screws 29′, the pointed inner ends thereof bite forcibly into drilled spots in the external threaded surfaces on which the rings are screwed and secured. The surfaces of rings 28 and 29 which contact the rounded inner peripheries 27′ of the discs are suitably hardened and ground and/or polished to reduce wear between the contacting parts while the discs are flexed under the loads to which the shock absorber is subjected.

The outer peripheral parts 27″ of the discs 27 are thickened between parallel planar surfaces which lie normal to the axis of sleeves 8 and 11 and are about as thick as the rounded inner peripheries of the central holes in the discs 27. Stout outer ring 30 is tightly gripped and widely received by many bolts and nuts 30′ between a pair of oppositely facing of said planar surfaces of said parts 27″, FIGS. 3 and 4. The said planar surfaces and the corresponding radial thickness of the ring 30 being ample to confine the flexing of the discs to their thinner portions thereof which lie radially between their thickened inner and outer peripheries.

As suggested in the brief description of the invention, the discs 27 are spring-tempered, resilient and stout enough to carry their loads resiliently without limiting desirable cushioning and dampening motion between the sleeves 8 and 11. As a practical matter, a gap of about one inch between the upper end of sleeve 11 and the shoulder at 10 at the lower end of thick part 8′ of sleeve 8 has been found to be adequate for stripping and handling a steel ingot weighing about ten tons, cast in a big-end-down mold with which my invention is illustrated and described under the following test conditions:

The discs were spaced about 7½ inches apart vertically by ring 30 at their thickened outer peripheries, and therefor also at their inner peripheries, were about 2 inches thick, vertically between said peripheries, were 70 inches in external overall diameter, and were made of spring tempered steel of pressure vessel quality. The ring 30 was about 4½ inches thick radially, ie., horizontally.

The shock absorber, so constructed, was expanded about 0.308 inches between the inner peripheries 27′ of the discs 27 under stripping conditions when about 145 tons of force was exerted by the push rod 21 on the ingot sufficient to eject it from the mold and/or stall and cut out the screw-driving motor as by opening the circuit breaker, not shown, provided and adjusted therefor. To cause the tongs 26 to grip the cast and stripped ingot sufficiently to lift and/or convey it apart from the mold, the inner peripheries 27′ of discs 27 were moved toward each other about 0.106 inches under a lifting force of about 49.7 tons applied by the push rod 21 to the upper hook arms 26′, of tongs 26 in the direction to cause the tongs to bite the ingot. See FIGS. 6, 7 and 8.

The push rod 21 is given its great vertical downward thrust and motion to strip the ingot from its mold, and given its smaller upward thrust and motion to grip and handle ingots. Reference is made again to Baker patent #3,460,610 and to FIGS. 2, 3, 4 and 5 herein. Vertical force and motion is applied to the push rod 21 by converting forcible rotation of the elongated, externally threaded screw 13 coacting with internally threaded, non-rotatable, axially movable nut 15, FIGS. 2–4, to which push rod 21 is secured via mounting seat 20 for nut 15 and tubular sleeve 16 secured to seat 20 above and to push rod 21 below, FIG. 2. Seat 20 and sleeve 16 are also referred to collectively as push rod housing 16. Screw 13 is rotated by the main driving motor and reduction gearing comprising but not shown in assembly 7 along with the thrust bearing disposed in housing 19. Screw 13 is rotated in one direction to drive nut 15, seat 20, tubular sleeve housing 16 and push rod 21 downwardly, and rotated in the opposite direction to pull the push rod upwardly with the same related parts of the ingot working mechanism.

To hold nut 15 from rotating relative to upper sleeve 8—8' and lower sleeve 11—11' while screw 13 is rotating and driving nut 15 and push rod 21 upwardly or downwardly, nut 15 is keyed to the mounting seat 20, which is part of push rod housing 16/20 mentioned above, FIG. 4, by parallel vertically disposed keys 18 lying in the plane of the axis of screw 13. Push rod housing including seat 20 is in turn keyed to sleeves 8—8' and 11—11' by keys 14, FIG. 5, with key guide 20 on sleeve 16.

Figure 6:
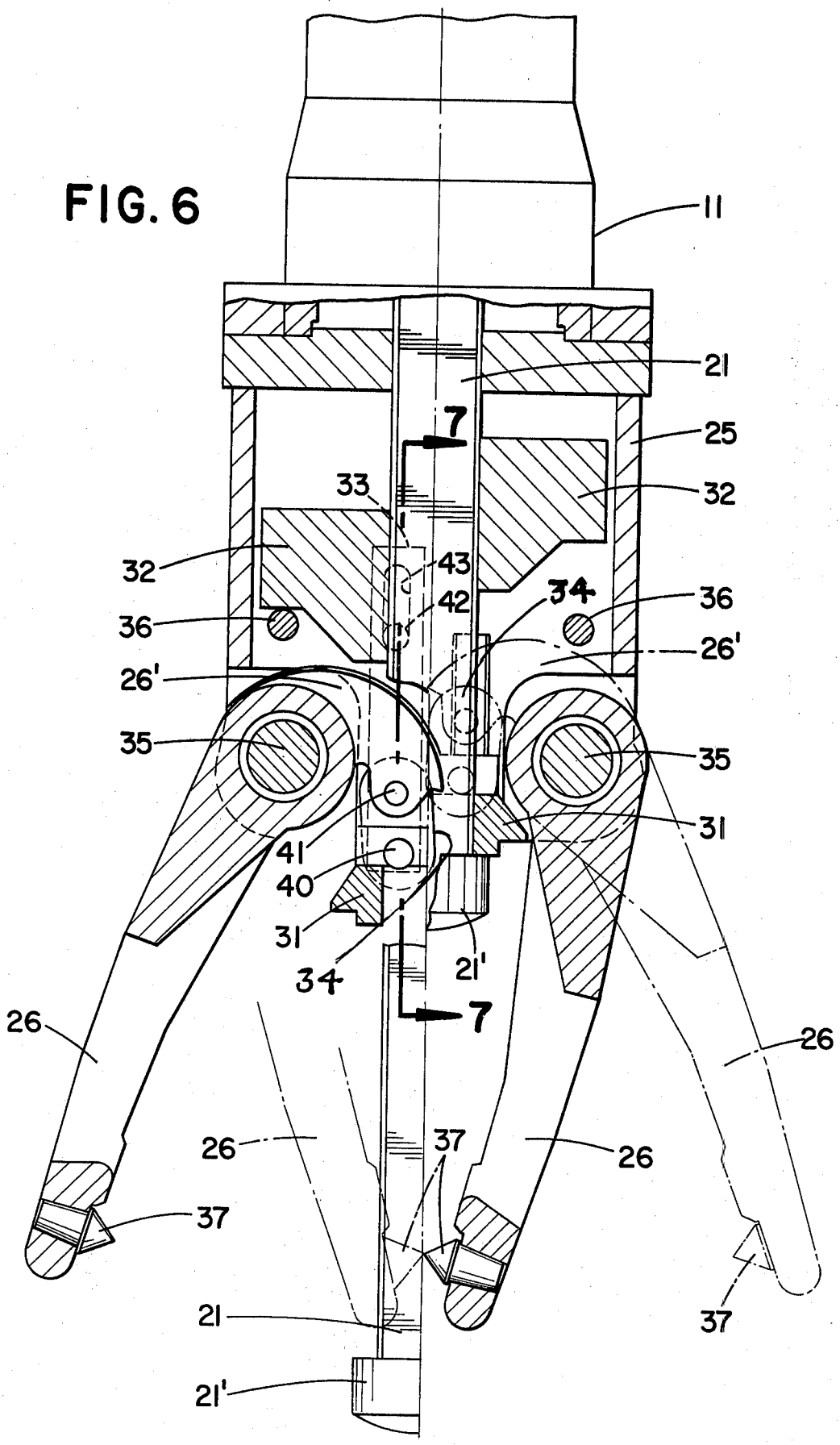
FIG. 6 is an enlarged vertical longitudinal sectional view of the tong head and tongs and the position of the tongs in relation to the push rod in both its raised and lowered positions.
Figure 7:
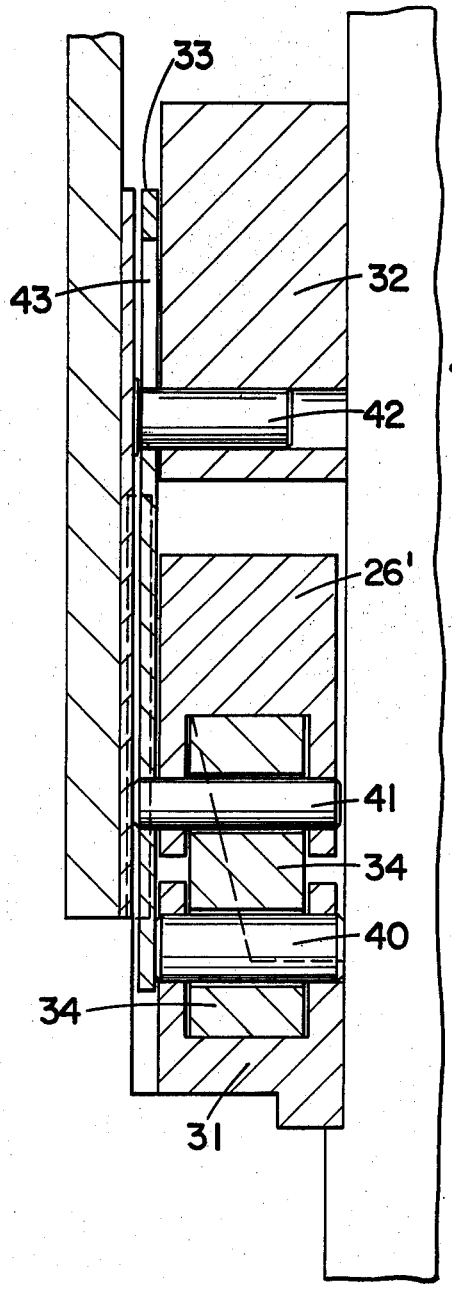
FIG. 7 is a slightly broken, vertical sectional view taken in the planes of the line 7—7 of FIG. 6 through the linkage between the slide block and the counterweight.
Figure 8:
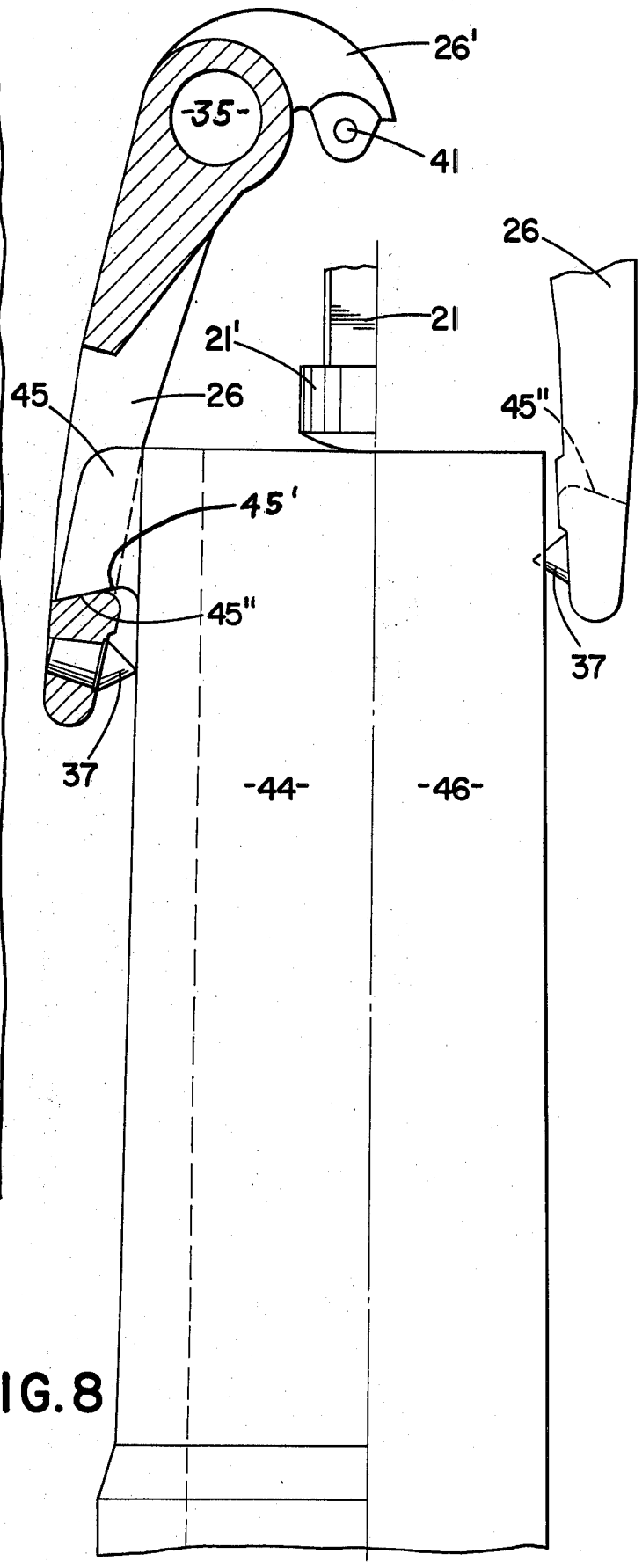
FIG. 8 is a sequence from left to right of two views of (1) a tong upholding the mold as the push rod engages the ingot and (2) a tong engaging the ingot after removal from the mold.

To strip a cast ingot 46 from its mold 44, FIG. 8, the mechanism M, FIG. 2, is arranged so it is directly over the top of the mold and the ingot cast therein, left side of mold 44 and push rod 21, FIG. 8. The tong levers 26, 26', FIGS. 6, 7 and 8 are opened by and along with downward travel of the push rod 21, left side of FIG. 6, with the left tong in full lines wide open corresponding to the lowermost position of the left half side of the push rod 21. The right tong is shown in phantom broken lines merely to correspond with the left tong, but not corresponding with the raised right half side of the push rod. The left half of slide block 31, which rests on the shouldered head 21' of the push rod 21, has also moved downwardly due to the gravitational pull of the counterweight 32. See also FIG. 6, wherein the right, as viewed, half of push rod 21, head 21', slide block 31 and counterweight 32 are shown in their raised positions.

It may be noticed in the left half of FIG. 6 and in the whole of FIG. 7, that pin 42 is carried by link 33 and has a lost motion fit within slot 43 of link 33, FIGS. 6 and 7. The long, thin counterweight link 33 is pinned to the hooked arm 26' of tong lever 26 by pin 41 and to push rod link 34 by pin 40, FIGS. 6 and 7. The push link 34 which is pinned to the hooked arm 26' of the tong lever 26 and counterweight link 33 is also pinned to the slide block 31 by pin 40. As the counterweight 32 moves downwardly, the slide block 31 with links 33 and 34 are also traveling downwardly and with it. The tongs 26, 26' are pivotally connected to the tong head 25 by a tong pivot pin 35, FIG. 6.

Since the tongs 26, 26' are pinned to the tong head 25 which is suspended from vertically movable sleeve 11 as restrained by shock absorber S, the downward travel of the components listed above opens the tongs 26, 26' against the resistance of the shock absorber's support of tong head 25. The tongs 26, 26' will continue opening until their maximum opening is reached. At this point the counterweight 32 will come to rest against fixed pin 36, thereby stopping all opening movement of the tongs 26.

After the tongs 26 are at their maximum open position, left lever in full lines, right lever in phantom, the main driving motor in assembly 7 is shut off manually or by a limit switch and the push rod 21 ceases in its downward motion, left side, FIG. 6. Thereafter tongs 26 are lowered and hooked under the mold lugs 45, FIG. 8. After the tong levers 26 are hooked to mold lugs 45, the driving motor in assembly 7 is manually reactivated to raise the push rod to close the tongs 26 and, with the coaction of the sloping surfaces 45' and 45'' of the lugs and tongs respectively, hold the mold and/or lift it when the push rod 21 is moved downwardly to separate the ingot from the mold. The components previously mentioned that were involved with the downward motion of the push rod 21 and opening of the tong levers 26 are now pulling the push rod 21 in an upward direction.

As the push rod 21 is drawn upwardly, the shoulder at top side of head 21' engages slide block 31, FIGS. 6 and 7, and the slide block in turn pushes the links and counterweight 32 upwardly, tending to close the tong levers 26 and grip the mold, left side of FIG. 8. Thereupon the electric driving motor in assembly 7 is automatically stopped by a conventional current sensor in the electrical controls in assembly 7 which stops the upward motion of push rod 21 and the inward swinging motion of the lower ends of tong levers 26. While the motor controls are reacting to the tong levers 26 gripping the mold, the discs 27 of shock absorber S feel the increased loading between sleeves 8 and 11, FIG. 3, and begin to deflect. This prevents the rotating kinetic energy in screw 13, the driving motor and gearing in assembly 7 from causing unwanted stresses in the ingot working mechanism. The mechanism, cast ingot, and mold are then raised by the overhead crane, utilizing the wire ropes and rotating sheaves 2, far enough off the ground to facilitate the stripping of the cast ingot from the mold.

When the mechanism and mold are raised off the ground, the stripping operation may begin. The driving motor in assembly 7 is then activated in the stripping direction, driving the push rod 21 downwardly and removing the gripping force of the push rod on the tong levers 26. But due to the inclined mating surfaces 45' and 45'' of the mold lugs 45 and tong levers 26, the downward pull from the weight of the mold and ingot, the tong levers 26 will hold the mold. The push rod 21 continues its forceful downward movement to engage the ingot and push it out of the mold at which time the shock absorber again limits the impact from the previously mentioned kinetic energy but in the opposite direction.

After the cast ingot is removed, the direction of push rod movement is reversed and raised upwardly. As the push rod moves upwards, its head 21' comes into contact with the slide block 31, which pushes the links and counterweight 32 upwards. This upward motion closes the tong levers 26 and puts a gripping force on the mold, left half FIG. 8. The mold is gripped with enough force to automatically shut off the driving motor of assembly 7 and compress the shock absorber S and flex the discs 27.

The mold is positioned where required by the overhead crane and lowered to the ground. Once the mold is on the ground, the driving motor is activated to open the tongs. The motor is stopped when the tongs have released the empty mold, and the ingot working mechanism is raised from the mold by the overhead crane utilizing the wire ropes and rotating sheaves 1. The stripping operation is complete.

The ingot handling mode of operation is as follows:

The tong levers 26 grip the cast ingot 46 by the tong bits 37, right half of FIG. 8. The tong levers 26 are opened only far enough for the tong bits 37 to clear the cast ingot. The push rod 21 is then raised in the upward direction until the screw-driving motor is automatically shut off by the motor controls. The tong levers 26 and tong bits 37 will have the impact limited by the sock absorber S and will have developed gripping force at this point to facilitate rotary, lifting, lowering, fore and aft and sidewise movement and positioning by the mechanism. The ingot may be taken to a soaking pit or otherwise and then released by lowering the push rod 21 and thereby opening up the tong levers 26. The entire mechanism and/or crane is then relocated for the next required operation.

Throughout all the phases of all the working operations of stripping ingots from molds and handling ingots and molds, and opening and closing the tongs, my shock absorber is an active working participant, whether cushioning shocks to preserve and protect the mechanism or storing energy to aid and maintain the grip of the tongs on the ingot.

If at any time during operation, the tongs 26 are struck by some object on the outside trying to close the tongs, the counterweights 32 will simply rise and prevent damage. If, while carrying an ingot, an obstruction collides with the ingot which tries to open the tongs 26, the force will be dissipated in my shock absorber.

In summary, my shock absorber is distinguished by its rugged simplicity, economical construction and operation, durability and saving in size, strength and cost of the whole mechanism because of its being protected from destructive shocks and overload stresses.

While I have illustrated and described a preferred form and embodiment of my invention, changes, modifications and improvements therein and thereon will come to the mind of those who use and understand my invention, the savings and advantages thereof, and the principles underlying the teachings and precepts of this specification. Therefore, I do not want to be limited in the scope and effect of my patent to the forms and embodiments specifically disclosed herein, nor in any way inconsistent with the progress by which the art has been promoted by my invention.

I claim:

1. In an ingot stripping and handling mechanism comprising a frame, a first tubular element depending from said frame, a second tubular element telescopically mounted over part of said first tubular element downwardly of said frame, said first and second tubular elements being coaxially aligned and axially movable relative to each other, means depending from said second tubular element for engaging ingots and ingot molds and for removing ingots from ingot molds, and means disposed within said frame and extending coaxially with said first and said second tubular elements for driving said first named means, the improvement which comprises:

a shock absorber comprising a first resilient metallic disc, a second resilient metallic disc, each of said discs being mounted on said mechanism in parallel spaced relationship to each other downwardly of said frame, each of said discs having a center opening including an inner periphery and an outer periphery radially spaced from said inner periphery, each of said discs being attached to each other by an annular element disposed between each of said discs adjacent to each of said outer peripheries, the inner periphery of said first disc engaging the outer surface of said first tubular element and the inner periphery of said second disc engaging the outer surface of said second tubular element.

2. The mechanism of claim 1 with a first restraining ring mounted on the exterior surface of said first tubular element upwardly of said first disc to restrain the inner periphery of said first disc against upward movement relative to said first tubular element, and a second restraining ring mounted on the exterior surface of said second tubular element downwardly of said second disc to restrain the inner periphery of said second disc against downward movement relative to said second tubular element.

3. The mechanism of claim 2 with a first inner lock ring mounted on the exterior surface of said first tubular element downwardly of said first disc to restrain the inner periphery of said first disc against downward movement relative to said first tubular element, and a second inner lock ring mounted on the exterior surface of said second tubular element upwardly of said second disc to restrain the inner periphery of said second disc against upward movement relative to said second tubular element.

4. The mechanism of claim 1 wherein the inner peripheries and the outer peripheries of each of said discs are thicker than the planar surfaces of each of said discs extending between each of said inner peripheries and each of said outer peripheries.

5. The mechanism of claim 3 wherein the surfaces of said first and said second lock rings and said first and said second restraining rings are suitably hardened to reduce wear between contacting parts as said discs are flexed under loads to which said shock absorber is subjected.

* * * * *